US009035843B1

(12) United States Patent
Mitu et al.

(10) Patent No.: US 9,035,843 B1
(45) Date of Patent: May 19, 2015

(54) FERRITE-LOADED, FABRY-PEROT CAVITY ANTENNA

(71) Applicant: KING FAHD UNIVERSITY OF PETROLEUM AND MINERALS, Dhahran (SA)

(72) Inventors: Sheikh Sharif Iqbal Mitu, Dhahran (SA); Farooq Sultan, Dhahran (SA); Raj Mittra, State College, PA (US)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 0 days.

(21) Appl. No.: 14/303,136

(22) Filed: Jun. 12, 2014

(51) Int. Cl.
*H01Q 1/38* (2006.01)
*H01Q 9/04* (2006.01)

(52) U.S. Cl.
CPC ..... *H01Q 9/0407* (2013.01)

(58) Field of Classification Search
CPC ... H01Q 15/006; H01Q 13/20; H01Q 15/148; H01Q 1/422; H01Q 9/0407; H01Q 1/38
USPC ..... 343/777, 787, 909
See application file for complete search history.

(56) References Cited

U.S. PATENT DOCUMENTS 4,937,585 A * 6/1990 Shoemaker ..... 343/700 MS
5,515,059 A 5/1996 How et al.
5,581,267 A * 12/1996 Matsui et al. ..... 343/837
5,990,850 A * 11/1999 Brown et al. ..... 343/912
7,683,833 B2 3/2010 Floyd et al.
8,378,908 B2 2/2013 Wisler et al.
8,743,003 B2 * 6/2014 De Lustrac et al. ..... 343/777
2004/0178794 A1 9/2004 Nelson
2008/0238774 A1 10/2008 Ratni
2013/0201068 A1 8/2013 Alexopoulos et al.

FOREIGN PATENT DOCUMENTS

JP 2009-58936 3/2009

OTHER PUBLICATIONS

Shaker J et al, "Application of Fabry-Perot Resonator for Sidelobe Suppression of Antenna Elements and Array," 31st European Microwave Conference Proceedings, Sep. 21-27, 2001. vol. 3, London.

* cited by examiner

*Primary Examiner* — Dameon E Levi
*Assistant Examiner* — Hasan Islam
(74) *Attorney, Agent, or Firm* — Richard C Litman

(57) ABSTRACT

The ferrite-loaded, Fabry-Perot Cavity antenna uses a novel superstrate based beam scanning/shaping mechanism by optimally placing three magnetized ferrite cylinders within the cavity. Beam scan in a certain direction required oppositely located ferrite cylinder to be axially biased using externally controlled DC magnetizing field. The FPC utilizes a composite dielectric superstrate to inversely relate the main-lobe-to-sidelobe ratio with scan-angle, which demonstrates larger reduction in side lobe level with increases angle of beam scan. The designed 10 GHz ferrite-loaded FPC antenna has dimensions of 6.4 cm×2 cm×1.6 cm. It achieves a −10 dB impedance bandwidth of 525 MHz, directivity of 11.04 dB and a broadside beam steering range of ±12° for 200 kA/m (0.25 T) changes in the externally applied axial magnetizing field.

7 Claims, 5 Drawing Sheets

FERRITE-LOADED, FABRY-PEROT CAVITY ANTENNA

BACKGROUND OF THE INVENTION

1. Field of the Invention

The present invention relates to antennas, and particularly to a ferrite-loaded, Fabry-Perot Cavity antenna that achieves a −10 dB impedance bandwidth of 525 MHz, directivity of 11.04 dB, controlled side lobe level and a phase shifter less broadside beam scanning of ±12° for 200 kA/m changes in the externally applied axial magnetizing field.

2. Description of the Related Art

The use of radars in the aviation industry has had a long history. Traditional radar systems radiate a high-power signal at a certain frequency, and point it towards a desired direction. Historically, the radar antenna was mechanically rotated to cover the complete 360° azimuth plane and the reflected signals from the targets illuminated by the radar beam were monitored to locate the targets. As the antenna fabrication and microcontroller technology progressed, electronic beam scanning came into being. In a uniform phased array antenna, the idea of electronic beam scan involves introducing a progressive phase shift in the input excitation of the antenna array elements. Depending on the type of the antenna array, variation of the progressive phase shift causes the main beam to steer/scan along the azimuth or the elevation planes.

Although the idea of progressive phase shift introduced in the array elements works well, implementing phase shifters in the antenna array feed network presents a considerable challenge. Antenna array designs employing microstrip patch elements often require a complete redesign of the existing feed network. Analogue or digital ferrite phase shifters have been widely used in phased array systems to introduce externally tunable progressive phase shift, needed for beam scanning.

Beam shaping/scanning can also be realized by composite ferrite-dielectric partially reflecting superstrate, placed above the radiating elements, to influence the radiated electromagnetic (EM) wave. This phase shifter less beam scanning is particularly important for a Fabry-Perot cavity (FPC) antenna, excited by minimum number of array elements to minimize feed network complexity and losses.

Radiation properties of a microstrip 2×1 array can be considerably improved, by letting it optimally excite a larger Fabry-Perot cavity (FPC) antenna, formed between the ground plane and the partially reflecting superstrate (PRS). Over the years, researchers have used frequency selective surfaces (FSSs), electromagnetic bandgap structures (EBGs) and artificial magnetic conductors (AMCs) to realize PRSs that can improve the gain, directivity and beam-shaping performance of a microstrip array antenna.

But optimal excitation of FPCs using a 2×1 microstrip array often requires a large spacing ($d>\lambda/2$) between the array elements (thinned array). This introduces grating lobes during the beam scanning process of the antenna.

Thus, a ferrite-loaded, Fabry-Perot Cavity antenna with composite superstrate is proposed to solve the aforementioned problems.

SUMMARY OF THE INVENTION

The ferrite-loaded Fabry-Perot Cavity (FPC) antenna is a novel structure, which includes magnetized ferrite cylinders optimally placed within the cavity to introduce externally controlled beam steering/shaping properties. The stepped dielectric superstrate of the FPC antenna is optimized to considerably reduce the sidelobe levels (SLL) The designed 10 GHz ferrite-loaded FPC antenna has dimensions of 6.4 cm×2 cm×1.6 cm. It achieves a 10 dB impedance bandwidth of 525 MHz, directivity of 11.04 dB and a beam steering range of ±12° for 200 kA/m change in the externally applied axial magnetizing field.

The features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The ferrite-loaded, Fabry-Perot Cavity antenna is a novel structure that includes magnetized ferrite cylinders, optimally placed within the cavity, to introduce externally controlled beam steering/shaping properties. The partially reflecting superstate of the FPC antenna is implemented using stepped dielectric material to considerably reduce the sidelobe levels (SLL). The designed 10 GHz ferrite-loaded FPC antenna has dimensions of 6.4 cm×2 cm×1.6 cm. It achieves a −10 dB impedance bandwidth of 525 MHz, directivity of 11.04 dB and a broad side beam scanning of $\Delta\theta=\pm12°$ by varying the external magnetic biasing field $\Delta H$=200 kA/m.

The present invention describes a directive beam shaping/steering technique, where magnetized ferrites are optimally positioned within the Fabry-Perot Cavity (FPC) to introduce desired taper in the radiated E-field phase distribution. This is achieved by exploiting the influence of the external magnetizing field on the gyromagnetic properties of ferrite and its interaction with the EM fields within the cavity. The proposed FPC antenna is excited by a 2×1 thinned microstrip array, which do not require complex and lossy feed and phase-shift network needed in traditional beam scannable phased array antenna. Directive and novel beam shaping characteristics of the proposed FPC antenna can make it attractive in interference avoidance, point to point wireless communication and radar applications for target tracking.

Figure 1:
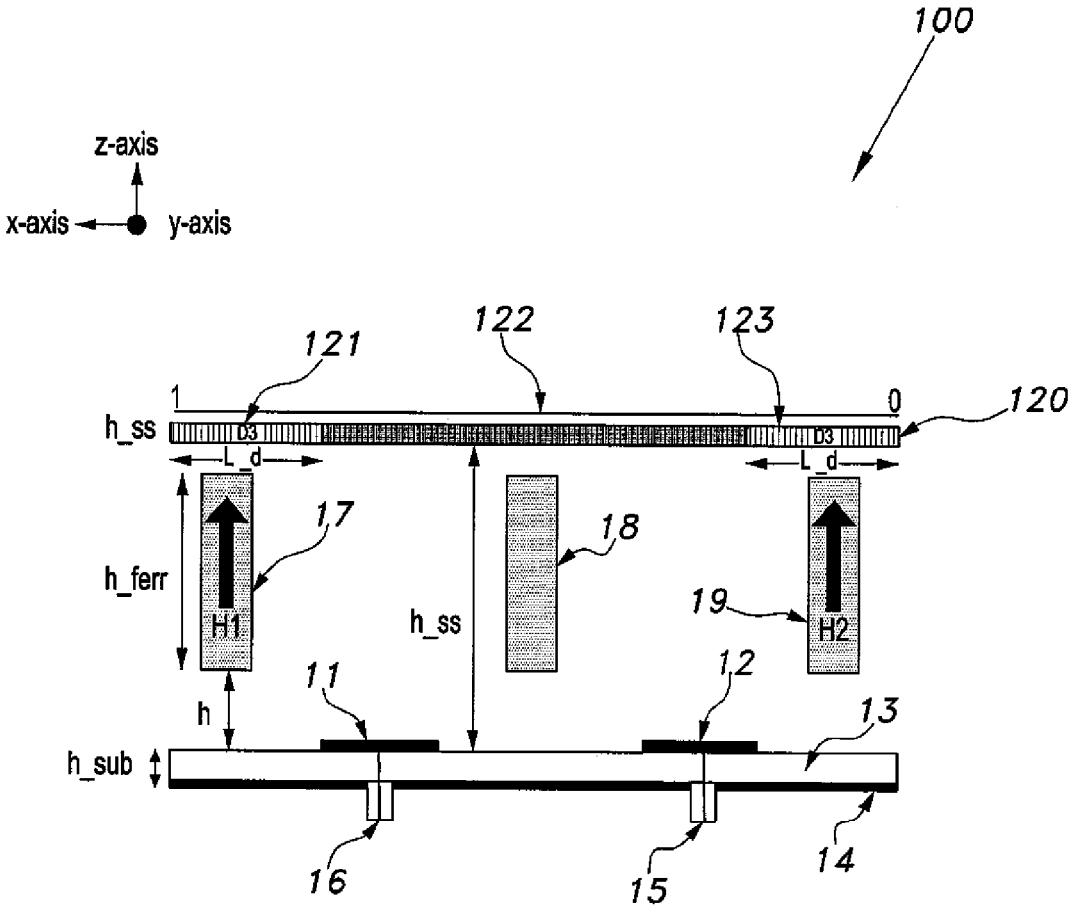
FIG. 1 is the side view drawing of the proposed ferrite loaded FPC antenna with tapered dielectric superstrate.

FIG. 1 shows a side view schematic of the proposed FPC antenna operating at 10 GHz. The antenna is excited by a 2×1 thinned microstrip array with three ferrite cylinders and a dielectric partially reflecting superstrate on top. The radiating elements, 11 and 12, are separated by a distance $d\geq\lambda/2$, excited by coaxial feeders 16 and 15, respectively, and are placed over a complete ground plane 14. The dielectric material used as substrate 13 has a relative permittivity $\in_r$=2.2 and thickness h_sub=1.6 mm. A superstrate is implemented using composite dielectric with $\in_r$=15.4 material for regions 120 and 121 and $\in_r$=2.2 for region 122. The composite dielectric is selected to considerably reduce the mainlobe to sidelobe ratio during scan. The thickness of the superstrate is 0.8 mm and is placed at a height h_ss=16 mm above the antenna array aperture. The value of h_ss has been chosen such that the FPC resonates at 10 GHz.

As shown in FIG. 1, a left-end ferrite cylinder 17, a central ferrite cylinder 18, and a right-end ferrite cylinder 19 are disposed in the cavity at intervals along the length of the cavity a height h=2 mm above the surface of the substrate 13. The ferrite cylinders are substantially identical and are composed of the Y220 material with $\in_r$=15.4 and a saturation magnetization, $M_s$=1780 Gauss. The height of the ferrite cylinders 17, 18, and 19, h_gerr, is approximately 20 mm. Although the central ferrite cylinder 18 remained unbiased, beam scan mainly depended on the external biasing of the ferrite cylinders 19 and 17 using separate +z-directed magnetizing fields H1 and H2, respectively. An observation line 123 is disposed 1 mm above the dielectric superstrate with the starting and ending points of the line indicated by the normalized distance 0 to 1, as shown in FIG. 1. The taper phase distribution resulted from the proposed FPC antenna is observed along this line to determine the scan angle and the sidelobe level of the radiated beam.

Figure 2:
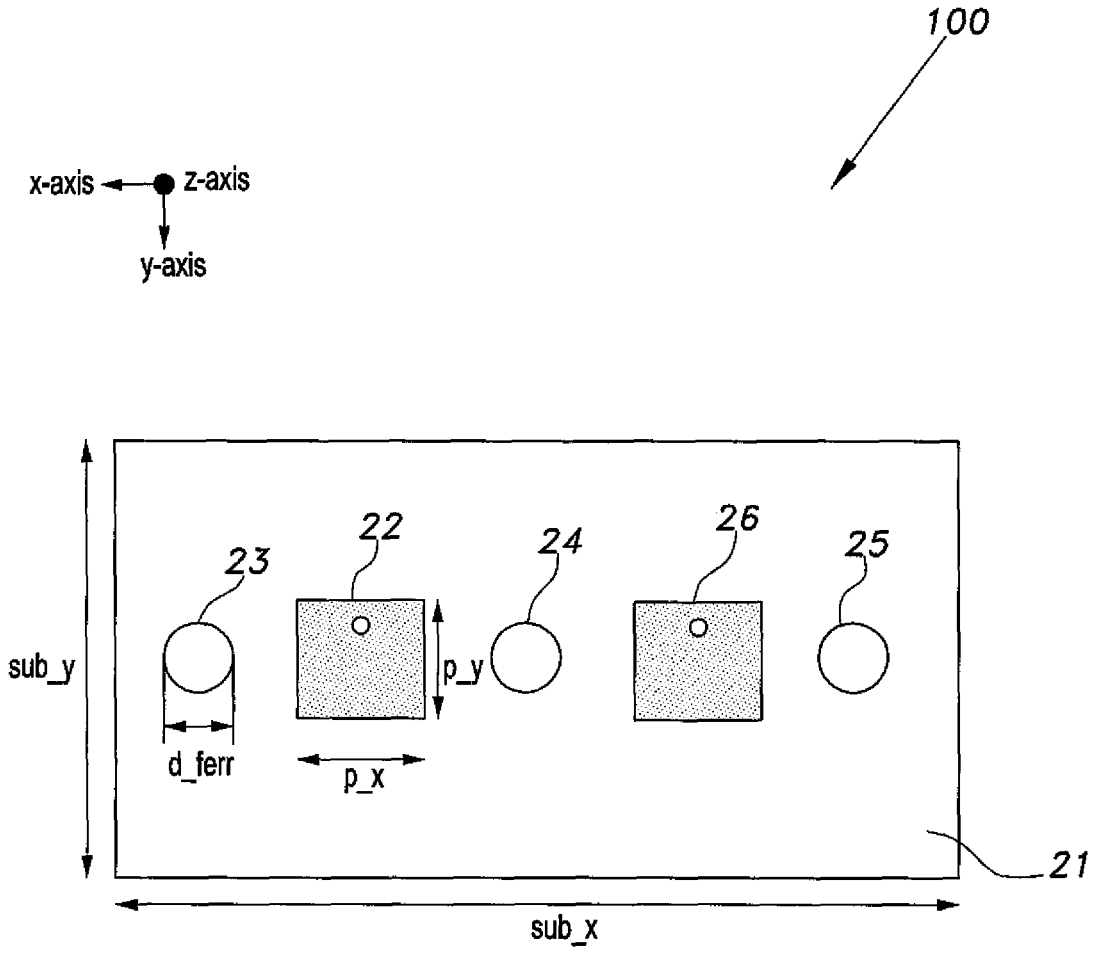
FIG. 2 is top view drawing of the FPC antenna with the locations of ferrite loading and patch array exciters.

The top view schematic of the present FPC antenna 100 is shown in FIG. 2. Rectangular patch 11 has a cross section 22 with dimensions p_x=8.5 mm and p_y=8.72 mm. Rectangular patch 12 has a cross section 22 of unspecified dimensions. Substrate 13's cross section 21 has the dimensions of sub_x=64 mm and sub_y=20 mm. The ferrite cylinder cross sections 23, 24 and 25 are each of diameter d_ferr=6 mm as indicated in FIG. 2.

Figure 3:
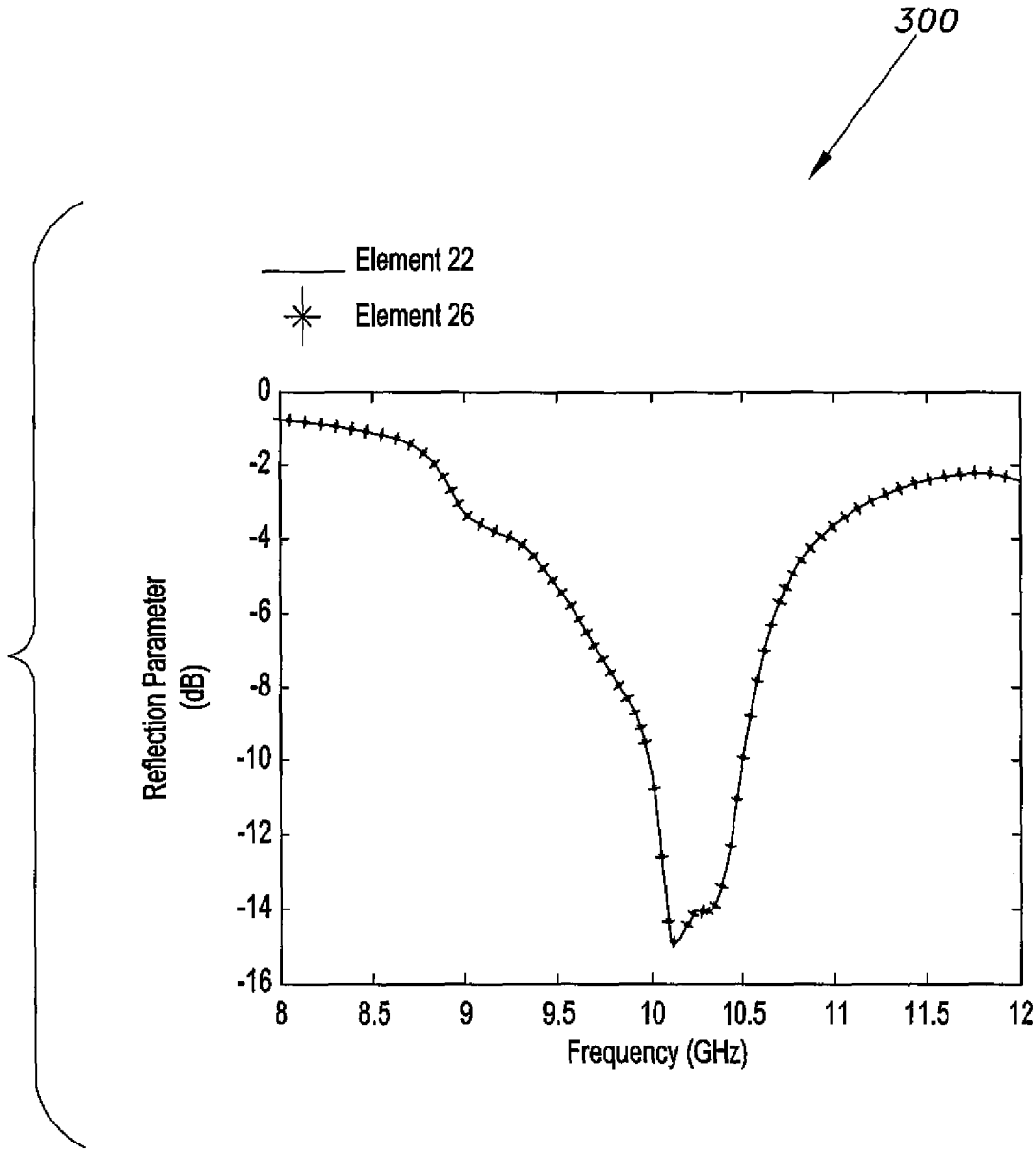
FIG. 3 is a plot showing reflection parameter (S11) of the proposed FPC antenna, excited by a thinned array of 2×1 microstrip patches.

FIG. 3 shows plot 300 detailing the reflection response (S11) of the designed antenna. Note that the 10 GHz FPC antenna has a −10 dB bandwidth of 525 MHz. It is also observed that the resonant frequency and impedance bandwidth are not affected by the changing DC magnetizing field H1 and H2.

Figure 4:
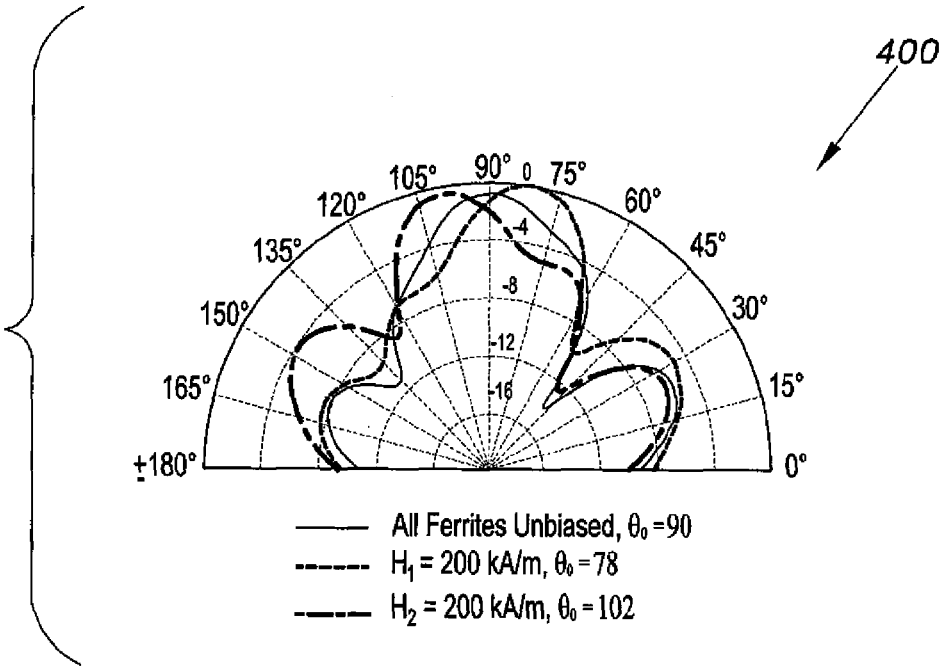
FIG. 4 is a plot showing the beam scanning properties of the uniform superstrate FPC antenna with changing external biasing ($H_1$ and $H_2$) applied to the outer ferrite cylinders.

FIG. 4 shows the 2-D radiation patterns in the $\phi$=0° plane for different biasing levels and an uniform superstrate layer of Duroid with $\in_r$=2.2 and t=1.6 mm. Although the central ferrite cylinder 18 remained unbiased, beam scanning required ferrite cylinders 19 and 17 to be biased by external magnetizing fields H1 and H2, respectively. Initially, under no biasing conditions, the maximum in the $\phi$=0° plane occurs at $\theta$=0. As the biasing value of H2 (applied to ferrite cylinder 19) starts to increase, the radiation pattern begins to tilt towards the positive theta while keeping H1=0. Thus, to squint the main beam towards +2°, +4°, +6° and +12° required H1=0 and H2 to be 50 kA/m, 75 kA/m, 100 kA/m and 200 kA/m, respectively. Similarly opposite directional beam scan towards −2°, −4°, −6° and −12° required H2=0 and H1 to be 50 kA/m, 75 kA/m, 100 kA/m and 200 kA/m, respectively. FIG. 4 shows the broadside beam scan of ±12°, where $\theta$=102° needs H1=0 and H2=200 KA/m (0.25 T) and $\theta$=78° needs H1=200 KA/m and H2=0. High sidelobe level of the steered radiation pattern is also shown in FIG. 4, which required further optimization of the FPC antenna.

Figure 5:
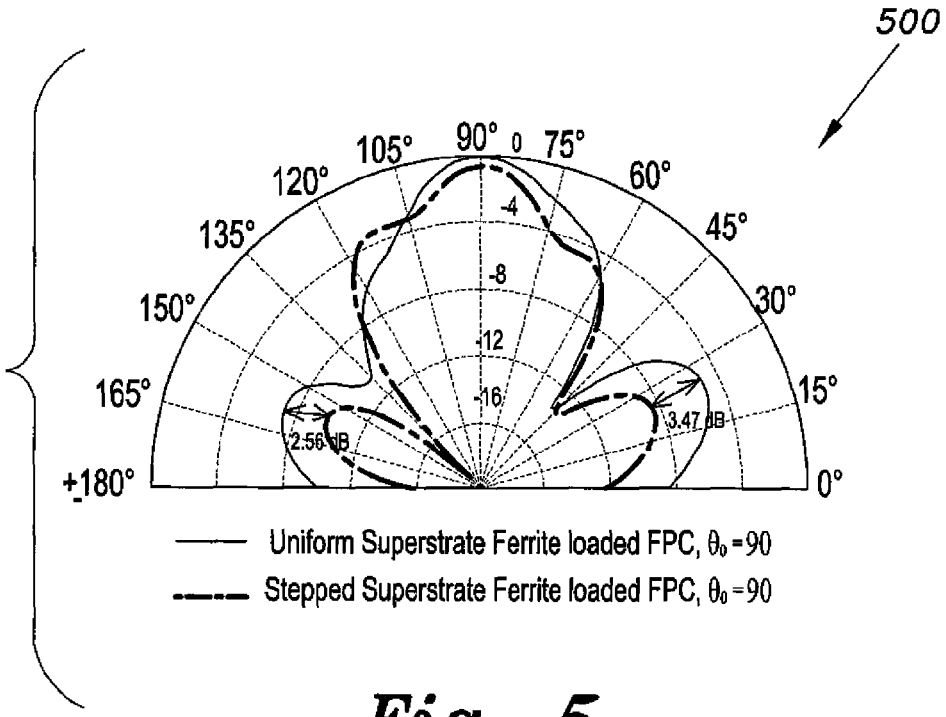
FIG. 5 is a plot showing the reduction of the antenna side-lobe-level of the proposed FPC antenna with steeped dielectric superstrate compared to uniform dielectric superstrate.
Figure 6:
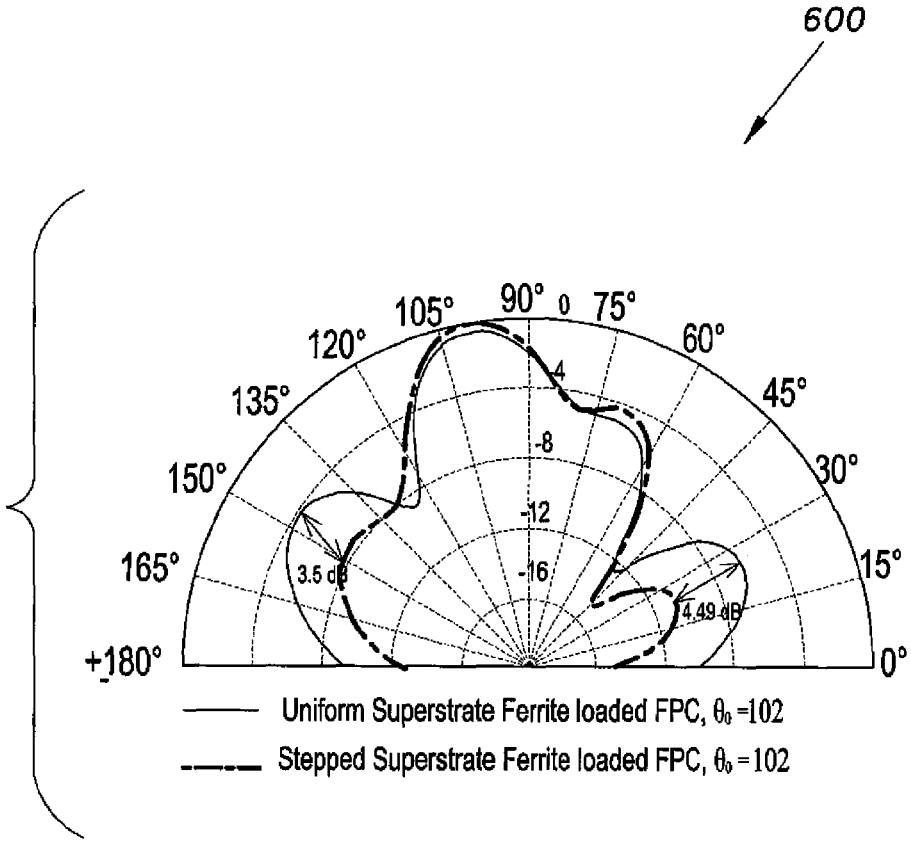
FIG. 6 is a plot showing considerable reduction of the side lobe level due to scanning the main beam of the proposed FPC antenna by axially biasing the outer ferrite cylinders with $H_2$=200 KA/m.

FIG. 5 shows a comparison between the 2-D directivity patterns of the unbiased FPC antenna for the uniform superstrate and the composite superstrate with stepped dielectric constant. It is observed that the placement of a stepped-dielectric reduces the side lobe level (SLL) by 3.47 dB and 2.56 dB, respectively. The main beam magnitude also decreases slightly by 0.58 dB, which is acceptable. The SLL is further improved when the main beam is steered towards 102° as shown in plot 600 of FIG. 6. Note that a reduction of SLL by 4.49 dB and 3.5 dB are observed in addition to 0.5 dB improvement of the mainlobe gain.

It is to be understood that the present invention is not limited to the embodiments described above, but encompasses any and all embodiments within the scope of the following claims.

We claim:

1. A Fabry-Perot Cavity (FPC) antenna, comprising:

a circuit board including a non-magnetic dielectric substrate;

a ground plane disposed on a bottom substrate portion of the circuit board;

a 2×1 thinned array of microstrip radiating elements disposed above the ground plane on a top substrate portion of the circuit board;

a uniform dielectric superstrate disposed above the circuit board a predetermined height above the radiating elements, the superstrate and the circuit board defining a cavity to form the FPC antenna excited by the microstrip array; and magnetized ferrite cylinders with $\in_1$ approximately=15.4 and $M_s$ approximately=1,780 Gauss disposed within the cavity in the near-field radiation region of the microstrip array.

2. The FPC antenna according to claim 1, further comprising external magnetizing fields proximate at least one of the magnetized ferrite cylinders of the FPC antenna, the external magnetizing fields controlling interaction between an EM field within the cavity and gyromagnetic properties of the magnetized ferrite cylinders thereby achieving a specific E-field phase taper needed for a required scan angle.

3. The FPC antenna according to claim 2, wherein the FPC antenna demonstrates large side lobe level (SSL) with a mainlobe-to-sidelobe ratio proportional to the scan angle.

4. A Fabry-Perot Cavity (FPC) antenna, comprising:

a circuit board including a non-magnetic dielectric substrate;

a ground plane disposed on a bottom substrate portion of the circuit board;

a 2×1 thinned array of microstrip radiating elements disposed above the ground plane on a top substrate portion of the circuit board;

a composite dielectric superstrate disposed above the circuit board a predetermined height above the radiating elements, the composite dielectric superstrate and the circuit board defining a cavity to form the FPC antenna excited by the microstrip array, the composite dielectric superstrate consisting of three regions with stepped dielectric constants of $\in_{r1}$=approximately 15.4, $\in_{r2}$=approximately 2.2 and $\in_{r3}$=approximately 15.4; and right, central, and left magnetized ferrite cylinders with $\in_r$ approximately =15.4 and $M_s$ approximately=1,780 Gauss disposed within the cavity in the near-field radiation region of the microstrip array, the composite dielectric superstrate considerably reducing sidelobe level and improving a radiated E-field distribution while considerably reducing the sidelobes.

5. The FPC antenna according to claim 4, further comprising external magnetizing fields proximate at least one of the magnetized ferrite cylinders of the FPC antenna, the external magnetizing fields controlling interaction between an EM field within the cavity and gyromagnetic properties of the magnetized ferrite cylinders thereby achieving a specific E-field phase taper needed for a required scan angle.

6. The FPC antenna according to claim 5, wherein to produce a beam scan with θ=92°, 94°, 96° and 102° the external magnetizing fields have an axially applied (+z-axis) intensity bias level biasing the right ferrite cylinder with H1=50 kA/m, 75 kA/m, 100 kA/m and 200 kA/m, respectively and an unbiased left and central ferrite cylinders; and to produce a beam scan with θ=88°, 86°, 84° and 78° the external magnetizing fields have an axially applied (+z-axis) intensity bias level biasing the left ferrite cylinder with H1=50 kA/m, 75 kA/m, 100 kA/m and 200 kA/m, respectively and an unbiased right and central ferrite cylinders.

7. The FPC antenna according to claim 6, wherein the composite dielectric superstrate reduces the side lobe level (SSL) and establishes an inverse relationship between the scan-angle and SSL, for the broadside radiation (θ=90), the SSL is reduced by approximately 3.47 and 2.56 dB for the right and left sidelobes, respectively, for steered main beam, considerably higher reduction of SLL is observed, for the scanned main beam with θ=102°, the SSL values are reduced by 4.49 and 3.5 dB for the right and left sidelobes, respectively.

* * * * *